US006053352A

United States Patent [19]

Cai

[11] Patent Number: 6,053,352

[45] Date of Patent: Apr. 25, 2000

[54] SLEEVE PROTECTOR FOR CUPS

[75] Inventor: Liming Cai, West Chester, Pa.

[73] Assignee: Dopaco, Inc., Exton, Pa.

[21] Appl. No.: 09/152,258

[22] Filed: Sep. 14, 1998

[51] Int. Cl.[7] ..... B65D 1/44

[52] U.S. Cl. ..... 220/739; 220/903; 220/671

[58] Field of Search ..... 220/739, 737, 220/738, 903, 671, 673, 675; 229/403, 400

[56] References Cited

U.S. PATENT DOCUMENTS 3,223,305 12/1965 Edwards ..... 229/400
3,443,714 5/1969 Edwards ..... 220/671
4,548,349 10/1985 Tunberg .
4,870,837 10/1989 Weins ..... 220/903
5,259,529 11/1993 Coale .
5,669,553 9/1997 Smith ..... 220/739
5,765,716 6/1998 Cai et al. .

*Primary Examiner*—Stephen Castellano
*Attorney, Agent, or Firm*—Dennison, Scheiner, Schultz & Wakeman

[57] ABSTRACT

A sleeve protector with an air insulating central gripping portion and an upper rim flange. The sleeve is enhanced by an upper protective stacking shoulder immediately below the rim flange, gripping points inwardly directed about the lower opening of the sleeve, the formation of insulating air channels or pockets with both vertical and lateral components, and the use of a transparent material for a viewing of underlying cup indicia.

11 Claims, 2 Drawing Sheets

SLEEVE PROTECTOR FOR CUPS

BACKGROUND OF THE INVENTION

Conventional disposable cups, of formed paperboard or an appropriate food-compatible synthetic resin or plastic, are normally of a thin wall construction with a strength little more than that required to contain the beverage for which the cup designed. Such cups are for the most part sufficient for their intended purposes, and require a minimal amount of material resulting in cost advantages.

However, the conventional thin wall cup leaves a little to be desired with regard to its insulating properties. For example, with cold beverages, moisture and condensation will normally collect on the outer surface of the cup, resulting in a rather uncomfortable feel to the cup and a slippery surface which might result in a slipping of the cup from the hand or a disruptive excess tightening of the hand on the thin wall of the cup.

With regard to hot beverages, the outer surface of the can may actually be too hot to grip in the hand which in turn could cause an unintentional release of the cup and a spilling of the hot beverage therein to the great discomfiture of the user.

It has recently become the practice to make available to the consumer protective sleeves which can be used at the option of the consumer to provide an insulating hand grip area for a more comfortable holding of the cup. An example of such a sleeve will be noted in commonly assigned U.S. Pat. No. 5,765,716, Cai et al.

SUMMARY OF THE INVENTION

The present invention comprises a sleeve protector defining a through passage for receiving cups and other beverage containers wherein the sleeve, in addition to providing an insulated hand grip portion, has multiple additional and enhanced functions arising from distinctive, structural features. While the sleeve has herein principally been described for use with cups, it is equally intended for use with other forms of beverage or drinking containers including juice bottles, soda cans and the like.

More specifically, the sleeve protectors of the invention provide for a firm gripping of the cup in the hand without any possibility of the protector-encased cup slipping slipping through the hand, a protection of the hand from spillage from the open mouth of the cup, a more positive non-slip engagement of the protector with the cup, an improved stacking of the protectors, provision for a viewing of cup indicia through the sleeve, and like features providing for a substantial increase in the practicality and versatility of the protector as compared to prior art constructions. The protector will have a configuration conforming to the container, such normally being generally conically tapered or cylindrical.

In achieving the desired objectives of the invention, the sleeve will preferably include flutes, corrugations or embossments peripherally about and for a major portion of the height of the sleeve whereby insulate air spaces are provided between the hand and the outer surface of a received cup. While such flutes or embossments can merely extend vertically along the height of the sleeve, they can also include an angular or laterally directed portion to both enhance the gripping surface of the sleeve or sleeve protector and provide insulating air pockets laterally of the vertical extent of the sleeve.

As a further enhancement in the ability of the sleeve to accommodate the hand holding the cup, the sleeve, which normally is of a rather thin wall plastic construction itself, will incorporate an annular outwardly extending flange integral with the upper end of the sleeve and extending outward thereof to strengthen the sleeve, provide an upper shoulder against which the hand can engage when lifting the cup, and providing an overlying shield for the hand should any beverage, whether hot or cold, spill over the top rim of cup.

Should enhanced rigidity be desired, the sleeve can be formed with a shoulder portion immediately below the top flange with the shoulder portion providing additional means against which the fingers of the hands can engage when lifting the sleeve protected cup. Such a shoulder would also enhance the stackability of the sleeves, allowing for easy and unencumbered access to the individual sleeves at the time of use.

Additional features contemplated by the present invention include the provision of the integral gripping projections or nibs about the lower edge of the sleeve which provide for an enhanced gripping of the cup by this lower edge portion of the sleeve as the sleeve is introduced upwardly about the cup. Such nibs will ensure a retention of the sleeve on the cup until the cup is physically withdrawn from the sleeve. There will be no accidental downward slipping of the sleeve from the cup or upward shifting of the cup from the sleeve during use.

Also contemplated by the present invention is to form the sleeve of a transparent synthetic resinous material allows for a full viewing of any indicia on the exterior of the cup, whether this be decorative, informative, or both.

Other features, objects and advantages will become apparent from the more detailed description of the invention following hereinafter.

DESCRIPTION OF PREFERRED EMBODIMENTS

Figure 1:
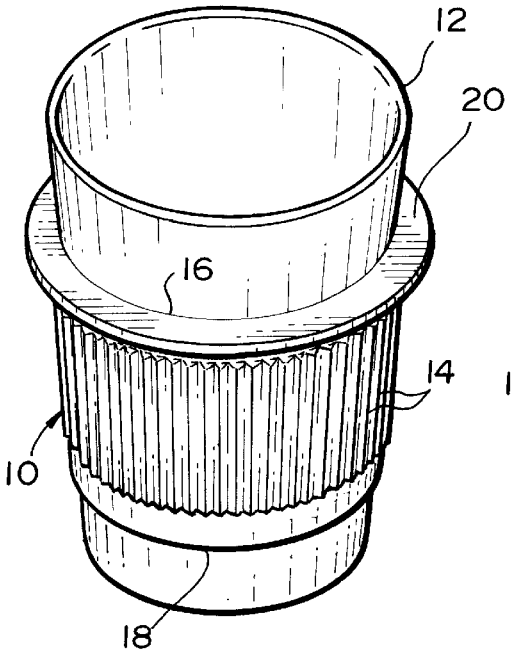
FIG. 1 is a perspective view of the sleeve mounted in protective engagement about a drinking cup.
Figure 2:
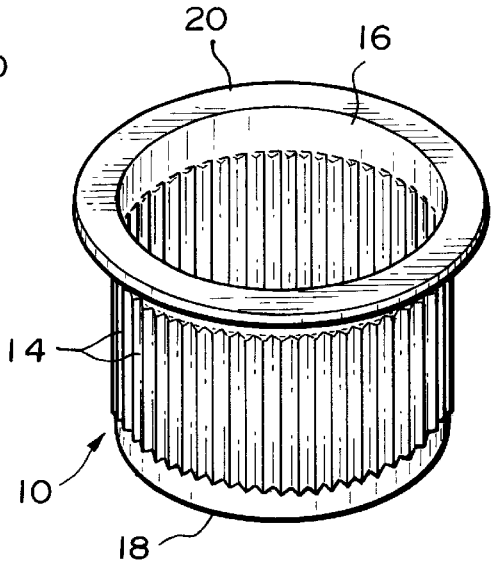
FIG. 2 is a top perspective view of a sleeve prior to mounting to a cup.

Referring now more specifically to the drawings, the sleeve or sleeve protector 10 has been illustrated in FIG. 1 in association with a conventional cup or glass 12. While a cup has been illustrated, it is to be appreciated that the sleeve 10, and the through passage defined thereby, can be adapted to beverage containers of a variety of different cross-sectional shapes and forms. In this regard, the sleeve 10 in FIG. 1 is of an inverted truncated slightly conical configuration, while the sleeve 10 in FIG. 2 is of a more exact cylindrical configuration. Equally, it is also conceivable that the sleeve be of other configurations for the accommodation of beverage containers of different configurations. Further, it is to be appreciated that while reference is made to a cup as the beverage container, the cup is herein specifically used to encompass all appropriate beverage containers such as cylindrical soda cans, juice bottles, water bottles, and the like.

The sleeve 10, as illustrated in FIGS. 1 and 2, includes a series of vertically extending and inwardly opening flutes or corrugations 14 formed therein peripherally thereabout for at least a major portion of the height of the sleeve and preferably terminating slightly short of upper and lower ends 16 and 18 of the sleeve to provide an insulated hand grip portion, basically as described in Cai U.S. Pat. No. 5,765,716.

The sleeve 10, normally but not exclusively of a thin material such as thermoformed polystyrene with the insulating effect obtained by the air spaces defined by the flutes, is substantially enhanced by an integral outwardly extending top flange 20 peripherally about the open upper end 16 of the sleeve. The presence of this flange 20 significantly rigidifies the sleeve, particularly about the open upper end thereof which initially receives the cup. This flange 20 also provides an overhang against which the fingers of a sleeve-encircling hand can upwardly engage to avoid any tendency for a slipping between the hand and the sleeve. Thus, less of a squeezing grip on the sleeve and cup, which are of a rather fragile nature, is required. Further, the flange, which as a practical matter will probably be of a radial width approximately equal to that of a finger, will also act as a means for protecting the hand against spillage of a beverage from the upper end of the cup or beverage container. This will be of particular importance were a hot liquid involved.

Figure 3:
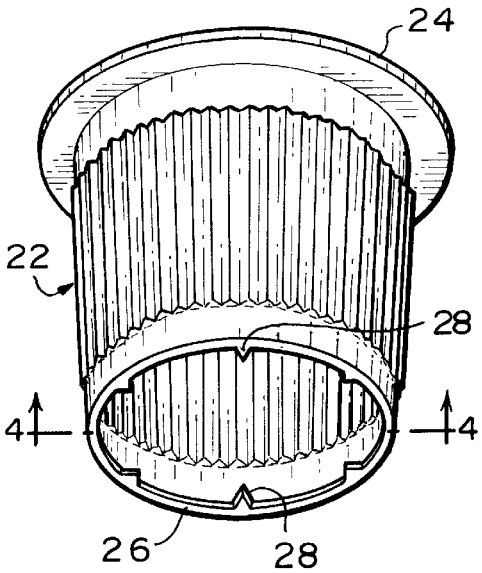
FIG. 3 is a bottom perspective view of the sleeve.
Figure 4:
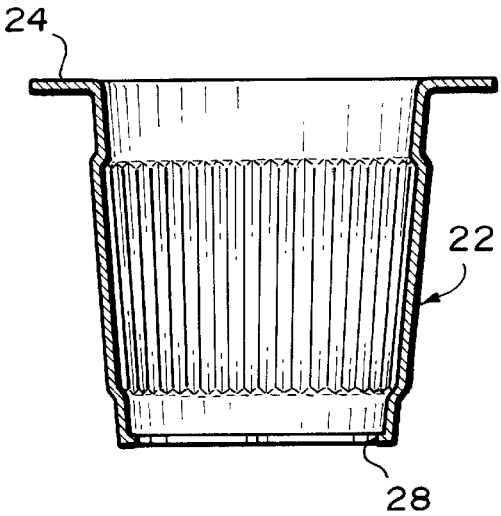
FIG. 4 is a cross-sectional view of the sleeve taken substantially on a plane passing along line 4—4 in FIG. 3.

FIGS. 3 and 4 illustrate a sleeve or sleeve protector 22 which is a variation of the sleeve 10. The sleeve 22 also preferably incorporates an integral flange 24 peripherally about the open upper end of the sleeve and extending, if not completely about this open upper end, at least for a major portion thereof. In addition, the sleeve 22 integral with the lower edge 26 thereof has a plurality of peripherally spaced inwardly directed sharp projections or nibs 28 which, formed from the material of the sleeve 22, have a degree of flexible resiliency so as to slightly downward fold as the sleeve 22 is moved upward to its fully seated position on a beverage container. At this point, the nibs 28, providing gripping prongs or barbs, tend to engage with the exterior surface of the container wall and effectively resist downward movement of the sleeve from the container. While the grip of the nibs can be overridden by a positive physical pulling of the sleeve from the cup, any accidental disengagement of the sleeve and cup would be effectively resisted.

The nibs formed as the sleeve itself is formed and depending upon manufacturing procedures, may actually result in the formation of a very narrow inwardly directed annular lip about the lower edge 26 of the sleeve 22.

Figure 5:
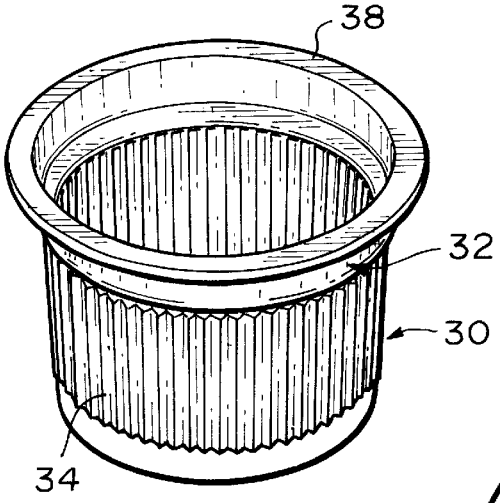
FIG. 5 is a top perspective view of a variation of the sleeve incorporating a shoulder-defining collar portion.
Figure 6:
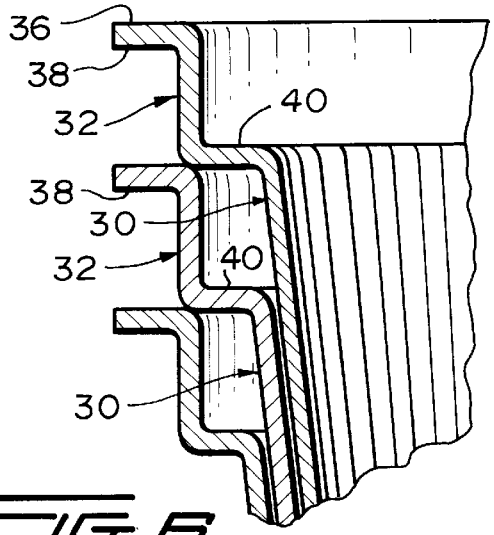
FIG. 6 is an enlarged cross-sectional detail illustrating the stacking ability of the sleeve of FIG. 5.

Another embodiment of sleeve protector 30 is illustrated in FIGS. 5 and 6. This sleeve 30 includes an integral collar 32 formed peripherally about the cup 30 between the upper extreme of the fluted or embossed hand grip intermediate portion 34 and the upper rim 36 of the sleeve which is surrounded by an integral radially outwardly extending planar flange 38. While the collar 32 can be provided without the flange 38, in the preferred form, the sleeve will also incorporate the flange.

The collar 32, will substantially enhance the rigidity of the sleeve and due to the outwardly offset nature of the collar 32 provide an insulating annular air pocket immediately below the top flange 38. The pocket also forms a collection chamber for accidental spillage and the like.

With reference to FIG. 6, it will be noted that the collar forms an outwardly offset shoulder 40 which, at its outer extremity, engages on the rim or rim portion 36 of a subjacent sleeve when the sleeves are stacked for shipping and storage. The vertical space thus provided between adjacent stacked cups, and particularly the annular flanges 38 thereof, is significant in greatly facilitating the dispensing of a single sleeve at a time. The thin nature of the preferred thermoformed polystyrene sleeves could otherwise be relatively difficult to separate, one at a time as needed, particularly in those instances wherein vertical flutes are provided and would tend to intimately internest. It will also be recognized that the annular shoulder 40, either with or without an associated flange 38, provides protection for the hand against spillage, and additionally provides an upper bearing surface against which the hand can engage aid in the holding of the sleeve and cup. In those instances wherein a flange is provide, the combined radial width of the flange 38 and shoulder 40 provide a substantial protective overhang.

Figure 7:
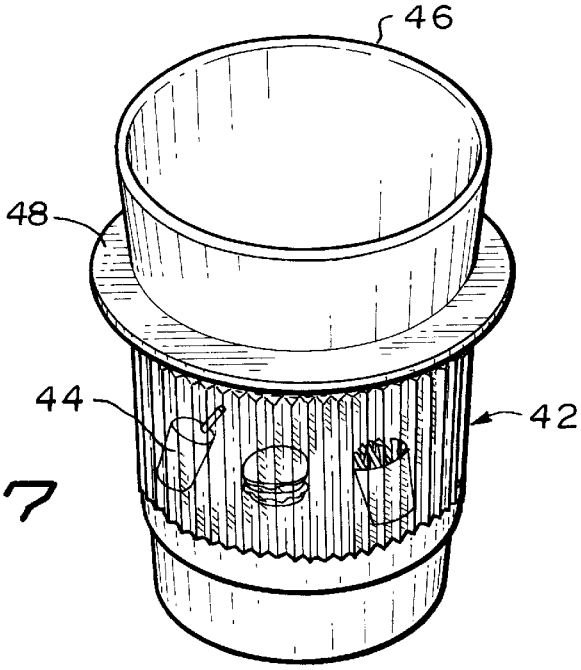
FIG. 7 illustrates the transparent nature of the sleeve for an exposure of cup indicia.

FIG. 7 illustrates a further embodiment of protective sleeve 42 wherein the sleeve is specifically formed of a transparent material, allowing printed indicia 44 provided on the exterior surface of the beverage container 46 to be clearly visible through the sleeve. Thus, the sleeve 42 need not in itself carry identifying indicia while at the same time allowing for a complete identification of the nature of the contents of the container by indicia on the container itself, whether this be decorative or informational indicia.

The sleeve 42 will preferably include an annular rigidifying flange 48 integral with the upper edge thereof, and can also be so formed as to incorporate a collar similar to collar 32 of sleeve 30, and the gripping points 28 of sleeve 22. In other words, it is to be appreciated that while features of particular significance have been described in conjunction with specific ones of the sleeves, these features are adaptable for use in conjunction with any of the disclosed sleeves in a manner which would be recognized from the descriptions herein.

Figure 8:
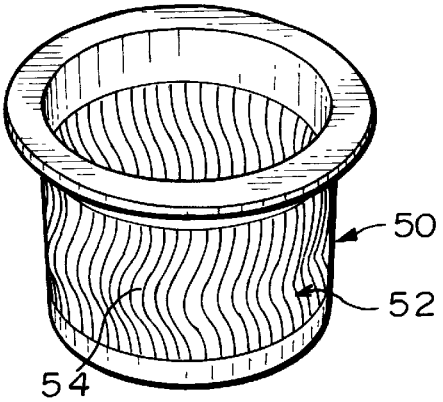
FIG. 8 is a top perspective view of a sleeve with formed flutes which individually extend, along portions thereof, vertically and laterally.
Figure 9:
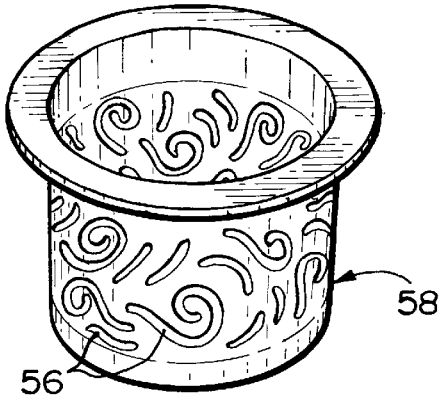
FIG. 9 is a top perspective view of a sleeve including outwardly directed embossments having components extending both vertically and laterally relative to the sleeve and defining internal insulating air pockets.

FIGS. 8 and 9 are particularly presented to illustrate variations in the manner of providing for the desired insulating air channels or chambers by thermoforming, embossing or otherwise forming such air spaces.

The sleeve 50 in FIG. 8 includes generally vertical flutes 52 with laterally offset curvilinear central portions 54. The lateral components of the formed flutes or air chambers provide an enhanced gripping surface against the tendency for the sleeve to slip vertically through the hand. In addition, the lateral components to the air chambers tend to enhance the effectiveness of the insulating air spaces.

The embossed curvilinear air chambers 56 formed in the sleeve 58 of FIG. 9, provided in patterns containing both vertical and lateral components, ensure the provision of fully effective insulating spaces while at a the same time providing for an enhanced gripping surface and a means for incorporating decorative indicia while enhancing the utilitarian features of the sleeve.

As will be recognized, the sleeves 50 and 58 can also incorporate such features as the illustrated top end flange, stacking shoulders, securing nibs and a transparent nature, all as heretofore described.

The foregoing is illustrative of the significant features of the invention, and while specific embodiments have been illustrated, it is to be appreciated that obvious variations will be recognized by those skilled in the art, and as such, the invention it to be limited only by the scope of the claims following hereinafter.

I claim:

1. A protector for encircling a beverage container and insulating the hand of a user from the container and beverage therein, said protector comprising a sleeve defining a through passage with vertically spaced opposed upper and lower ends adapted to receive a container therein and therethrough, said sleeve including a hand-grip portion between said upper and lower ends, means for insulating said hand-grip portion relative to a received container, and a flange integral with said upper end of said sleeve and extending laterally outward therefrom relative to said through passage and above said hand-grip portion for shielding the hand of the user from liquid spilling over the edge of said container.

2. The protector of claim 1 including gripping projections integral with said lower end of said sleeve and extending laterally inward toward said through passage.

3. The protector of claim 2 wherein said through passage includes an outwardly offset collar between said upper end and said hand-grip portion, said collar defining a laterally outwardly directed shoulder substantially parallel to said flange laterally inward of and below said flange.

4. The protector of claim 3 wherein said means for insulating said hand-grip portion comprises multiple air chambers formed in said hand-grip portion and opening inward into communication with said through passage.

5. The protector of claim 4 wherein said sleeve is transparent for a direct viewing of a received container therethrough.

6. The protector of claim 4 wherein said air chambers extend both vertically of said sleeve and laterally in a peripheral direction thereabout.

7. The protector of claim 1 wherein said through passage includes an outwardly offset collar between said upper end and said hand-grip portion, said collar defining a laterally outwardly directed shoulder substantially parallel to said flange laterally inward of and below said flange.

8. The protector of claim 1 wherein said means for insulating said hand-grip portion comprises multiple air chambers formed in said hand-grip portion and opening inward into communication with said through passage, said air chambers extend both vertically of said sleeve and laterally in a peripheral direction thereabout.

9. The protector of claim 1 wherein said sleeve is transparent for a direct viewing of a received container therethrough.

10. A protector for encircling and protectively enclosing a beverage container, said protector comprising a sleeve defining a through passage with vertically spaced opposed upper and lower ends adapted to receive a container therein and therethrough, said sleeve including a hand-grip portion between said upper and lower ends, means for insulating said hand-grip portion relative to a received container, said means for insulating said hand-grip portion comprising multiple inwardly directed air chambers formed in said hand grin portion and directly communicating with said through passage, selected ones of said air chambers extending both vertically of said sleeve and laterally about said sleeve, wherein said air chambers are defined as flutes which extend predominately vertical and include a laterally offset central portion.

11. The protector of claim 10 wherein selected ones of said air chambers are of curvilinear configurations.

* * * * *